US011475841B2

(12) United States Patent
Hatanaka et al.

(10) Patent No.: US 11,475,841 B2
(45) Date of Patent: Oct. 18, 2022

(54) DISPLAY CIRCUITRY INCLUDING SELECTIVELY-ACTIVATED SLEW BOOSTER

(71) Applicant: Apple Inc., Cupertino, CA (US)

(72) Inventors: Shingo Hatanaka, San Jose, CA (US); Derek Keith Shaeffer, Redwood City, CA (US); Kenichi Ueno, Tokyo (JP); Masaki Kinoshita, Ota (JP); Nobutaka Shimamura, Kawasaki (JP)

(73) Assignee: Apple Inc., Cupertino, CA (US)

( * ) Notice: Subject to any disclaimer, the term of this patent is extended or adjusted under 35 U.S.C. 154(b) by 95 days.

(21) Appl. No.: 17/000,258

(22) Filed: Aug. 21, 2020

(65) Prior Publication Data

US 2021/0056907 A1 Feb. 25, 2021

Related U.S. Application Data

(60) Provisional application No. 62/890,511, filed on Aug. 22, 2019.

(51) Int. Cl.
*G09G 3/3258* (2016.01)

(52) U.S. Cl.
CPC ... *G09G 3/3258* (2013.01); *G09G 2300/0819* (2013.01); *G09G 2310/0291* (2013.01); *G09G 2320/0233* (2013.01); *G09G 2330/023* (2013.01)

(58) Field of Classification Search
CPC ... G09G 2300/0819; G09G 2310/0291; G09G 2320/0233; G09G 2330/023
USPC ..... 345/691
See application file for complete search history.

(56) References Cited

U.S. PATENT DOCUMENTS

| | | | | |
|---|---|---|---|---|
| 9,189,995 | B2 | 11/2015 | Messmer | |
| 9,311,859 | B2 | 4/2016 | Chaji et al. | |
| 9,318,069 | B2 | 4/2016 | Nambi et al. | |
| 10,359,885 | B2 | 7/2019 | Brahma et al. | |
| 10,373,569 | B2 | 8/2019 | Ninan et al. | |
| 10,614,749 | B2 | 4/2020 | Kim et al. | |
| 2010/0238203 | A1 | 9/2010 | Stroemer et al. | |
| 2011/0148893 | A1* | 6/2011 | An | G09G 3/3614 345/545 |
| 2015/0084694 | A1* | 3/2015 | Lee | H03F 1/483 330/255 |
| 2017/0032755 | A1* | 2/2017 | Ko | H03F 3/45475 |
| 2019/0350502 | A1 | 11/2019 | Bohm et al. | |
| 2019/0362679 | A1 | 11/2019 | Pyo et al. | |
| 2020/0135122 | A1 | 4/2020 | Song et al. | |

* cited by examiner

*Primary Examiner* — Amare Mengistu
*Assistant Examiner* — Gloryvid Figueroa-Gibson
(74) *Attorney, Agent, or Firm* — Fletcher Yoder, P.C.

(57) ABSTRACT

A system may include buffer circuitry that receives an input signal representative of image data for display via a pixel. The buffer circuitry may provide a first driving signal during a first frame of the image data to the pixel based on the input signal. The buffer circuitry may include slew booster circuitry. The slew booster circuitry may supply a voltage boost (e.g., additional voltage) to differential pair stage circuitry of the buffer circuit in response to a difference between the input signal and a second driving signal exceeding a threshold increase a rate of change of the input signal provided. The second driving signal may be provided to the pixel during a second frame of the image data preceding the first frame.

20 Claims, 5 Drawing Sheets

DISPLAY CIRCUITRY INCLUDING SELECTIVELY-ACTIVATED SLEW BOOSTER

CROSS REFERENCE TO RELATED APPLICATIONS

This application claims priority from and the benefit of U.S. Provisional Application Ser. No. 62/890,511 entitled "DISPLAY CIRCUITRY INCLUDING SELECTIVELY-ACTIVATED SLEW BOOSTER," filed Aug. 22, 2019, which is hereby incorporated by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to increasing a rate of change associated with a change of value of a driving signal used to cause a pixel to emit light. Electronic displays are found in numerous electronic devices, from mobile phones to computers, televisions, automobile dashboards, and many more. Individual pixels of the electronic display may collectively produce images by permitting different amounts of light to be emitted from each pixel. This may occur by self-emission as in the case of light-emitting diodes (LEDs), such as organic light-emitting diodes (OLEDs), or by selectively providing light from another light source as in the case of a digital micromirror device (DMD) or liquid crystal display (LCD). When driving a pixel to emit light as part of a presentation of an image, the pixel may be driven via differing driving signals over time (e.g., a voltage signal at a relatively lower value than an original voltage signal between frames of image data). In some cases, when the difference between the original value of the driving signal and the new value of the driving signal is greater than or equal to a threshold, the change between gray levels that the pixel emits light at is noticeable to a viewer of the display and/or may slow driving of the pixel for a next image frame presentation. In this way, the difference in driving values may manifest as visual artifacts since slow driving of the pixel may be perceivable by a user and/or portions of the electronic display emit visibly different (e.g., perceivable by a user) amounts of light.

With this in mind, the present embodiments described herein are related to systems and methods for improving a rate of change of the value provided as a driving signal, thereby improving the operation of the electronic display. The systems to perform the improvement may be external to an electronic display and/or an active area of the electronic display, in which case they may be understood to provide a form of external compensation. In some cases, the systems to perform the compensation may be located within the electronic display (e.g., in a display driver integrated circuit).

The adjustment to the rate of change may take place in a digital domain or an analog domain, the net result producing a driving signal (e.g., programming voltage, programming current, data signal) that reached its desired value relatively faster than without the improved rate of change. The driving signal may be transmitted to a pixel of the electronic display to cause the pixel to emit light. When the driving signal is adjusted to account for the difference in value between driving signals of the pixel, images resulting from compensated data signals to the pixels may improve (e.g., reduced visual artifacts).

Indeed, this disclosure describes adjustment methods that use a slew booster alongside additional driving circuitry to provide a voltage boost to cascade stage circuitry when the difference between an ongoing or present data signal for the pixel (e.g., a first driving signal) and a next data signal for the pixel (e.g., a second driving signal) is greater than or equal to a threshold. In this disclosure, the data signal or driving signal used to drive the pixel during a current emission cycle is referred to as the first driving signal, while a data signal that is to be used in a next frame to cause the pixel to emit light is referred to as the second driving signal. The driving signals may be analog signals or digital signals.

The slew booster may be selectively activated in response to the difference between the first driving signal (e.g., output driving signal) and the second driving signal (e.g., input driving signal) being greater than or equal to a threshold value. In this way, the additional voltage boost is provided in the situations when a change in the driving signal provided to the pixel is greater than a threshold, which may correspond to visual artifacts being present on the displayed image. At the same time, the additional voltage boost is not provided when the difference between the driving signals is not large enough to produce visual artifacts, thereby preserving the energy or power used by the driving circuitry without basic performance degradation such as power, noise and input voltage offset. Thus, an electronic device including the selectively activated slew booster may benefit from usage of the slew booster with a reduced impact to overall power consumption of the electronic device. Other benefits may include not using self-bias current boosting techniques, such as positive feedback, to provide the slew boost, and thus may provide a steady operation (e.g., relatively constant voltage output) while eliminating stuck states that positive feedback circuit generally tend to have due at least in part to process variations.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
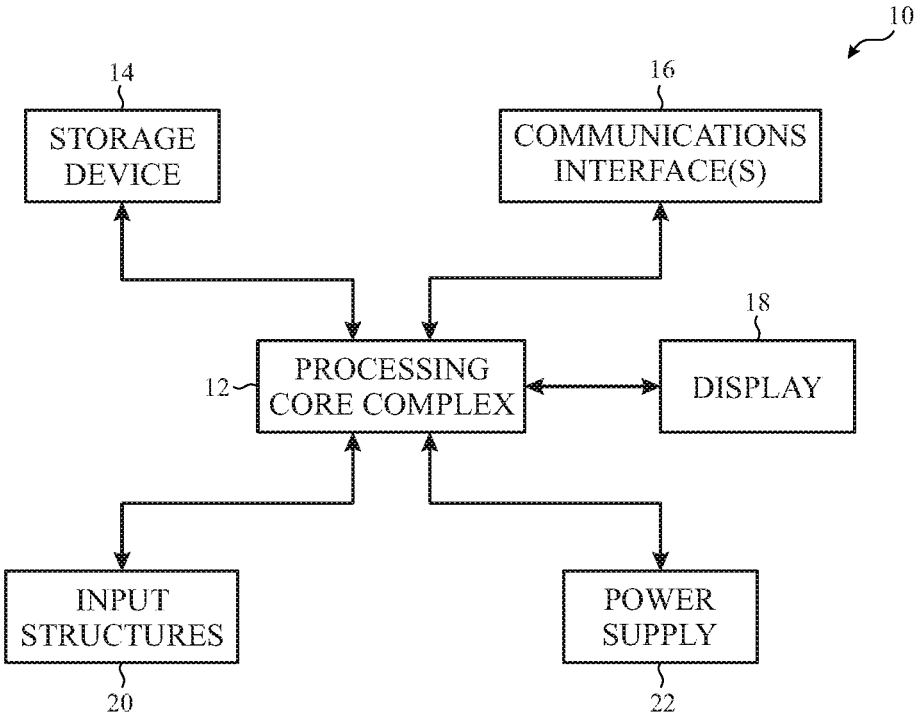
FIG. 1 is a schematic block diagram of an electronic device, in accordance with an embodiment.

One or more specific embodiments are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to systems and methods that improve a transition rate (e.g., rate of change) of a value of a driving signal used to cause a pixel of an electronic display to emit light to improve operation of the electronic display. Electronic displays may include light-modulating pixels, which may be light-emitting in the case of light-emitting diode (LEDs), such as organic light-emitting diodes (OLEDs), but may selectively provide light from another light source as in the case of a digital micromirror device (DMD) or liquid crystal display (LCD). While this disclosure generally refers to self-emissive displays, it should be appreciated that the systems and methods of this disclosure may also apply to other forms of electronic displays that use signals which values changes at an undesirable slow transition rate, and should not be limited to self-emissive displays. When the electronic display is a self-emissive display, an OLED represents one type of LED that may be found in a self-emissive pixel, but other types of LEDs may also be used.

The systems and methods of this disclosure may adjust a rate of change or transition rate of a driving signal provided to a pixel of a display by adjusting a rate in which the driving signal may reach a desired value. When operating an electronic display to present image frames at a relatively higher frequency (e.g., 60 hertz (Hz) increased to a higher frequency, such as 120 Hz, 200 Hz, 240 Hz, 300 Hz, and so on), a change in driving signal value between a first frame and a second frame of image data may manifest as a visual artifact to a user of the electronic display. However, when the rate of change of the driving signal value is increased, the change in the driving signal value may not be perceivable between these two frames of image data. With this in mind, a slew booster may be used to increase the rate of change of the driving signal between the frames of image data to a suitable rate that minimizes the likelihood of visual artifacts being perceivable. Furthermore, in some examples, the rate of change of the driving signal value may be perceivable when a difference between the ongoing driving signal and the next driving signal is greater than a threshold. In these cases, the slew booster may be selectively activated in response to the difference being greater than the threshold.

With this in mind, in some embodiments, a buffer circuit of an electronic display may use the slew booster may be selectively engaged to increase the rate of change of a voltage signal provided to processing and/or amplification circuitry of the buffer circuit, thereby causing driving signals being applied to a pixel to be output more efficiently.

For example, when a difference between a previously provided driving signal and a current driving signal is greater than some threshold, the slew booster may couple an additional current source to differential pair stage circuitry of the buffer circuitry to cause the differential pair stage circuitry to operate more quickly. That is, the additional current source coupled to the differential pair stage circuitry may cause the difference between the two signals provided to the differential pair stage circuitry to be determine more quickly and provided to the cascade stage circuitry. When supplied with a voltage or current representative of the difference between the two signals from the differential pair stage circuitry, the cascade stage circuitry may supply control signals to drive a P-type metal-oxide-semiconductor (PMOS) switch to couple a high voltage source to the output stage circuitry or to drive an N-type metal-oxide-semiconductor (NMOS) switch to couple a low voltage source to the output stage circuitry. In this way, the output stage circuitry may output the desired driving signal to the pixel more quickly because the cascade stage circuitry may drive the output stage circuitry to connect the appropriate voltage source to the pixel more quickly. As such, transistors of the output stage circuitry may turn on faster, and thus may cause a relatively faster rate of change in a value of the driving signal output from the output stage circuitry. Since the rate of change of the output driving signal increases, driving of the pixels at a higher frequencies may be enabled. Furthermore, visual artifacts caused by a relatively slow rate of change of the output driving signal when driving the display at a relatively higher frequency may be reduced.

By selectively activating the slew booster when a difference between the previous driving signal and the next driving signal is greater than a threshold, the rate of change of the driving signal may increase. The present embodiments described herein limit the use of additional power and avoids the use of the additional power when the threshold is not exceeded. In this way, the slew booster may power on when the difference between the first driving signal and the second driving signal is greater than or equal to a threshold but may not power on when the difference is less than a threshold. Additional benefits afforded from the slew booster being selectively activated include the slew booster being unable to degrade offset or noise performance of the buffer circuitry. The slew booster may not degrade performance of the buffer circuitry since the slew boost may be disabled in between uses.

A general description of suitable electronic devices that may include a self-emissive display, such as a LED (e.g., an OLED) display, and corresponding slew booster circuitry of this disclosure are provided. FIG. 1 is a block diagram of one example of a suitable electronic device 10 may include, among other things, a processing core complex 12 such as a system on a chip (SoC) and/or processing circuit(s), a storage device 14, communication interface(s) 16, a display 18, input structures 20, and a power supply 22. The blocks shown in FIG. 1 may each represent hardware, software, or a combination of both hardware and software. The electronic device 10 may include more or fewer elements. It should be appreciated that FIG. 1 merely provides one example of a particular implementation of the electronic device 10.

The processing core complex 12 of the electronic device 10 may perform various data processing operations, including generating and/or processing image data for presentation on the display 18, in combination with the storage device 14. For example, instructions that are executed by the processing core complex 12 may be stored on the storage device 14. The storage device 14 may be volatile and/or non-volatile memory. By way of example, the storage device 14 may include random-access memory, read-only memory, flash memory, a hard drive, and so forth.

The electronic device 10 may use the communication interface(s) 16 to communicate with various other electronic devices or elements. The communication interface(s) 16 may include input/output (I/O) interfaces and/or network interfaces. Such network interfaces may include those for a personal area network (PAN) such as Bluetooth, a local area network (LAN) or wireless local area network (WLAN) such as Wi-Fi, and/or for a wide area network (WAN) such as a cellular network.

Using pixels containing LEDs (e.g., OLEDs), the display 18 may show images generated by the processing core complex 12. The display 18 may include touchscreen functionality for users to interact with a user interface appearing on the display 18. Input structures 20 may also enable a user to interact with the electronic device 10. In some examples, the input structures 20 may represent hardware buttons, which may include volume buttons or a hardware keypad. The power supply 22 may include any suitable source of power for the electronic device 10. This may include a battery within the electronic device 10 and/or a power conversion device to accept alternating current (AC) power from a power outlet.

Figure 2:
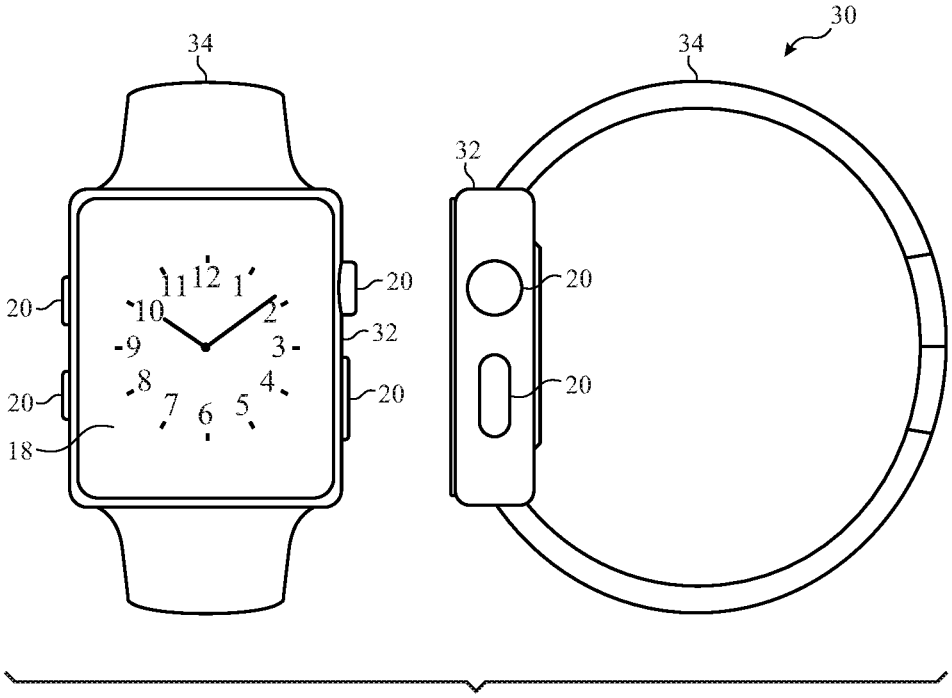
FIG. 2 is a perspective view of a watch representing an embodiment of the electronic device of FIG. 1, in accordance with an embodiment.

As may be appreciated, the electronic device 10 may take a number of different forms. As shown in FIG. 2, the electronic device 10 may take the form of a watch 30. For illustrative purposes, the watch 30 may be any Apple Watch® model available from Apple Inc. The watch 30 may include an enclosure 32 that houses the electronic device 10 elements of the watch 30. A strap 34 may enable the watch 30 to be worn on the arm or wrist. The display 18 may display information related to the watch 30 operation, such as the time. Input structures 20 may enable a person wearing the watch 30 to navigate a graphical user interface (GUI) on the display 18.

Figure 3:
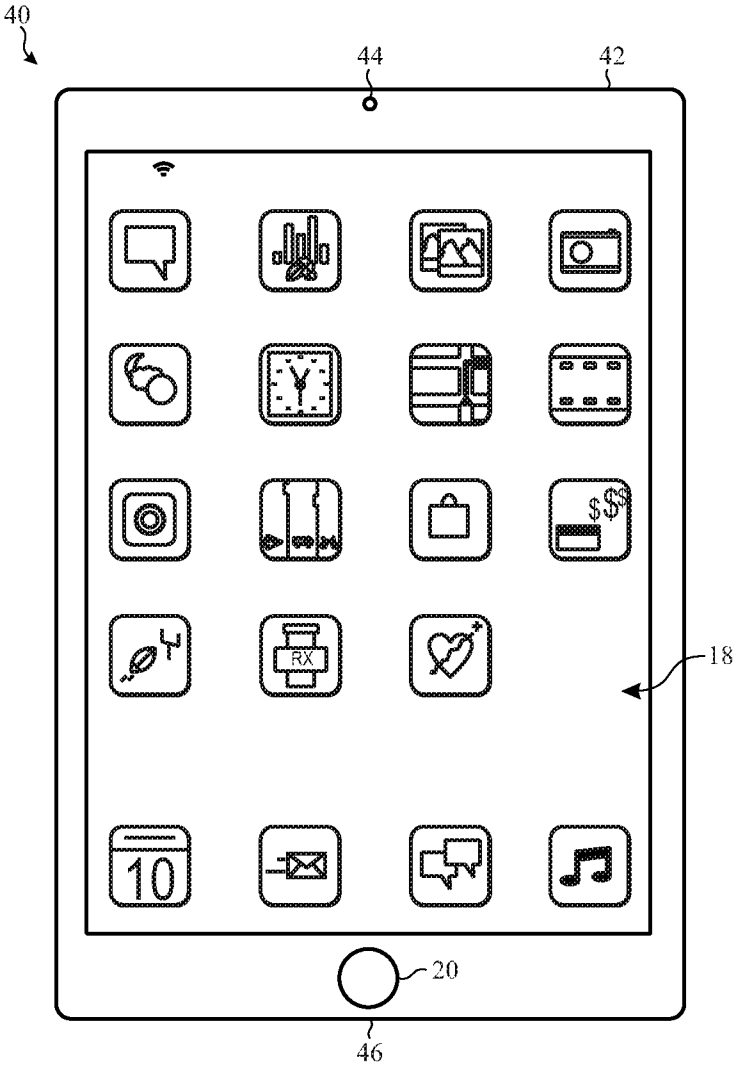
FIG. 3 is a front view of a tablet device representing an embodiment of the electronic device of FIG. 1, in accordance with an embodiment.

The electronic device 10 may also take the form of a tablet device 40, as is shown in FIG. 3. For illustrative purposes, the tablet device 40 may be any iPad® model available from Apple Inc. Depending on the size of the tablet device 40, the tablet device 40 may serve as a handheld device such as a mobile phone. The tablet device 40 includes an enclosure 42 through which input structures 20 may protrude. In certain examples, the input structures 20 may include a hardware keypad (not shown). The enclosure 42 also holds the display 18. The input structures 20 may enable a user to interact with a GUI of the tablet device 40. For example, the input structures 20 may enable a user to type a Rich Communication Service (RCS) message, a Short Message Service (SMS) message, or make a telephone call. A speaker 44 may output a received audio signal and a microphone 46 may capture the voice of the user. The tablet device 40 may also include a communication interface 16 to enable the tablet device 40 to connect via a wired connection to another electronic device.

Figure 4:
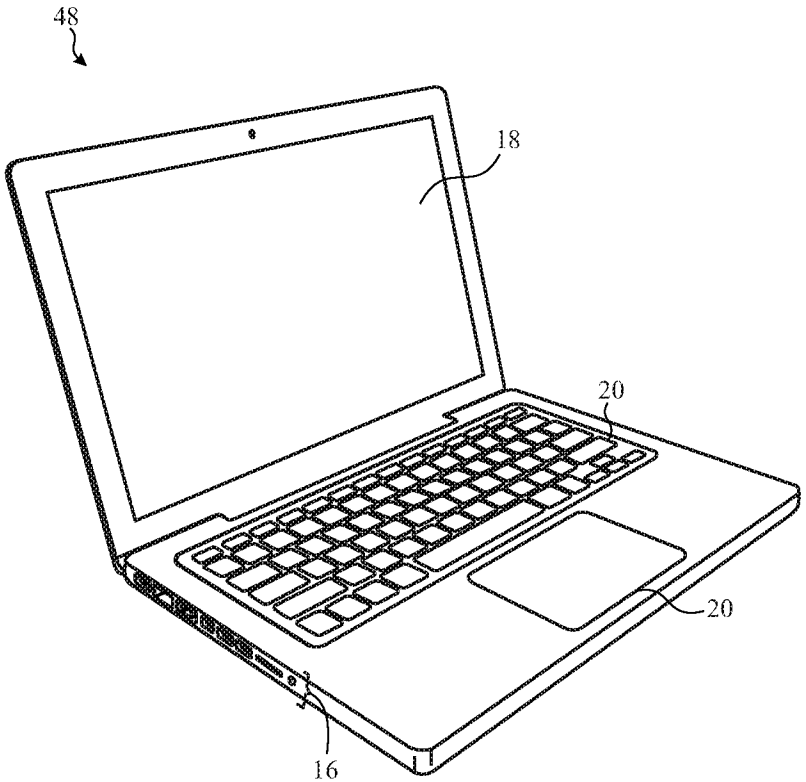
FIG. 4 is a front view of a computer representing an embodiment of the electronic device of FIG. 1, in accordance with an embodiment.

A computer 48 represents another form that the electronic device 10 may take, as shown in FIG. 4. For illustrative purposes, the computer 48 may be any Macbook® or iMac® model available from Apple Inc. It should be appreciated that the electronic device 10 may also take the form of any other computer, including a desktop computer. The computer 48 shown in FIG. 4 includes the display 18 and input structures 20, such as in the form of a keyboard and a track pad. Communication interfaces 16 of the computer 48 may include, for example, a universal serial bus (USB) connection.

Figure 5:
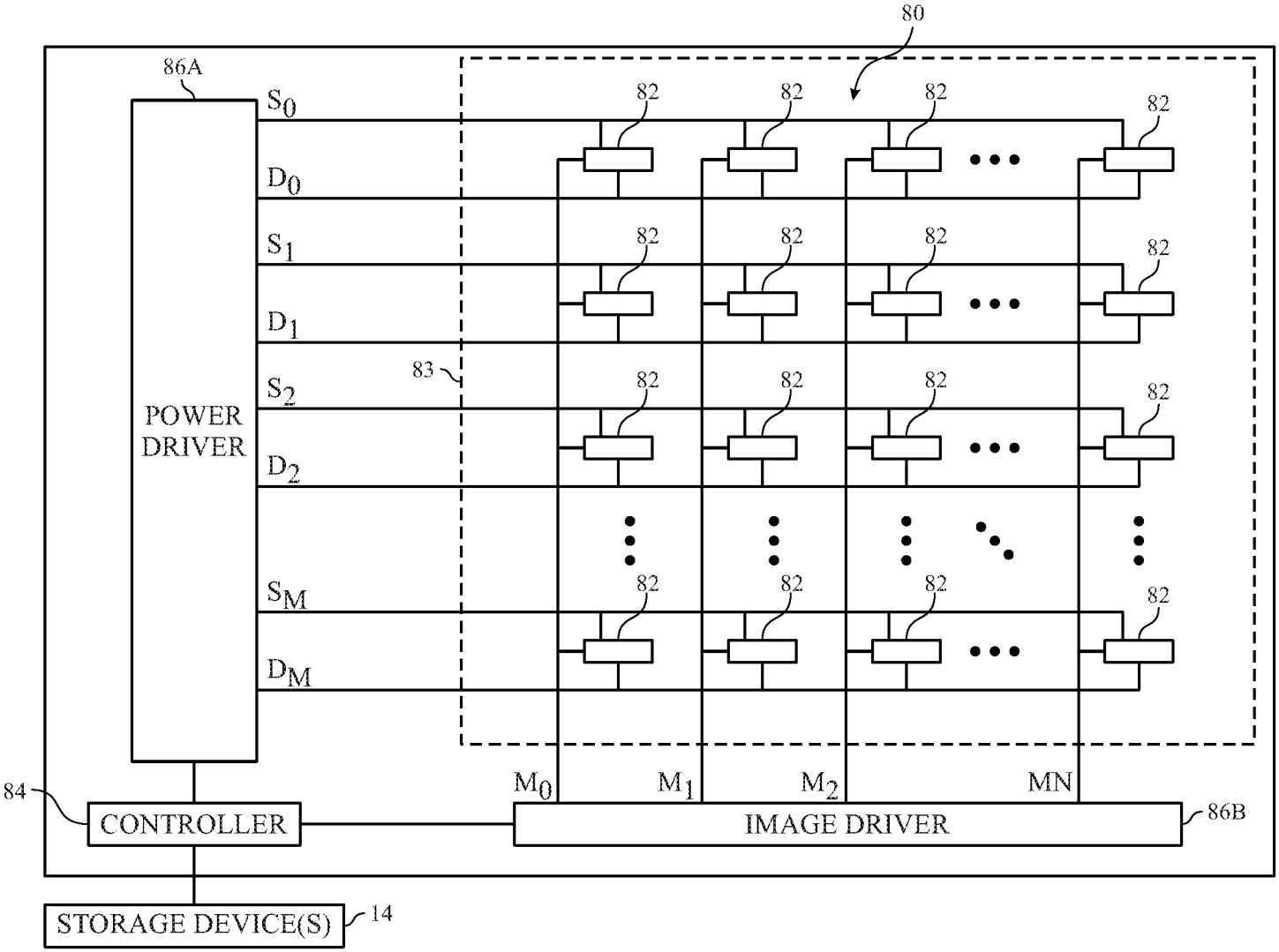
FIG. 5 is a circuit diagram of the display of the electronic device of FIG. 1, in accordance with an embodiment.

The display 18 may include a pixel array 80 having an array of one or more pixels 82 within an active area 83. The display 18 may include any suitable circuitry to drive the pixels 82. In the example of FIG. 5, the display 18 includes a controller 84, a power driver 86A, an image driver 86B, and the array of the pixels 82. The power driver 86A and image driver 86B may drive individual of the pixels 82. In some cases, the power driver 86A and the image driver 86B may include multiple channels for independent driving of multiple pixels 82. Each of the pixels 82 may include any suitable light-emitting element, such as a LED, one example of which is an OLED. However, any other suitable type of pixel may also be used. Although the controller 84 is shown in the display 18, the controller 84 may sometimes be located outside of the display 18. For example, the controller 84 may be at least partially located in the processing core complex 12.

The scan lines S0, S1, . . . , and Sm and driving lines D0, D1, . . . , and Dm may connect the power driver 86A to the pixel 82. The pixel 82 may receive on/off instructions through the scan lines S0, S1, . . . , and Sm and may receive programming voltages corresponding to data voltages transmitted from the driving lines D0, D1, . . . , and Dm. The programming voltages may be transmitted to each of the pixel 82 to emit light according to instructions from the image driver 86B through driving lines M0, M1, . . . , and Mn. Both the power driver 86A and the image driver 86B may transmit voltage signals as programmed voltages (e.g., programming voltages) through respective driving lines to operate each pixel 82 of an active area 83 at a state determined by the controller 84 to emit light. Each driver 86 may supply voltage signals at a duty cycle and/or amplitude sufficient to operate each pixel 82.

The intensities of each pixel 82 may be defined by corresponding image data that defines particular gray levels for each of the pixels 82 to emit light. A gray level indicates a value between a minimum and a maximum range, for example, 0 to 255, corresponding to a minimum and maximum range of light emission. Causing the pixels 82 to emit light according to the different gray levels causes an image to appear on the display 18. In this way, a first brightness level of light (e.g., at a first luminosity and defined by a gray level) may emit from a pixel 82 in response to a first value of the image data and the pixel 82 may emit at a second brightness level of light (e.g., at a first luminosity) in response to a second value of the image data. Thus, image data may facilitate creating a perceivable image output by indicating light intensities to be generated via a programmed data signal to be applied to individual pixels 82.

The controller 84 may retrieve image data stored in the storage device 14 indicative of various light intensities. In some examples, the processing core complex 12 may provide image data directly to the controller 84. The controller 84 may control the pixel 82 by using control signals to control elements of the pixel 82. The pixel 82 may include any suitable controllable element, such as a transistor, one example of which is a metal-oxide-semiconductor field-effect transistor (MOSFET). However, any other suitable type of controllable elements, including thin film transistors (TFTs), p-type and/or n-type MOSFETs, and other transistor types, may also be used.

The controller 84 may use a driving signal (e.g., programming voltage, programming current) and transmitted control signals to control the luminance, also sometimes referred to as brightness, of light (Lv) emitted from the pixel 82. It should be noted that luminance and brightness are terms that refer to an amount of light emitted by a pixel 82 and may be defined using units of nits (e.g., candela/$m^2$) or using units of lumens. The driving signal may be selected by a controller 84 to cause a particular luminosity of light emission (e.g., brightness level of light emitted, measure of light emission) from a light-emitting diode (LED) (e.g., an organic light-emitting diode (OLED)) of the self-emissive pixel 82 or other suitable light-emitting element.

In some embodiments, the power driver 86A and/or the image driver 86B may include buffer circuitry used to output the driving signals. This buffer circuitry may include a slew booster to selectively couple a voltage source to differential pair stage circuitry when a difference between a current input voltage (e.g., pixel data) and a previously output voltage is greater than some threshold. Selectively increasing voltage supplied to the differential pair stage circuitry, and thus selectively increasing voltage supplied to cascade stage circuitry, may enable output stage circuitry to be driven with control signals having higher current values. Driving a transistor with a control signal (e.g., gate control signal) characterized by a higher current value may increase a rate of change of a driving signal output as a result of the transistor being driven by a stronger gate signal.

Figure 6A:
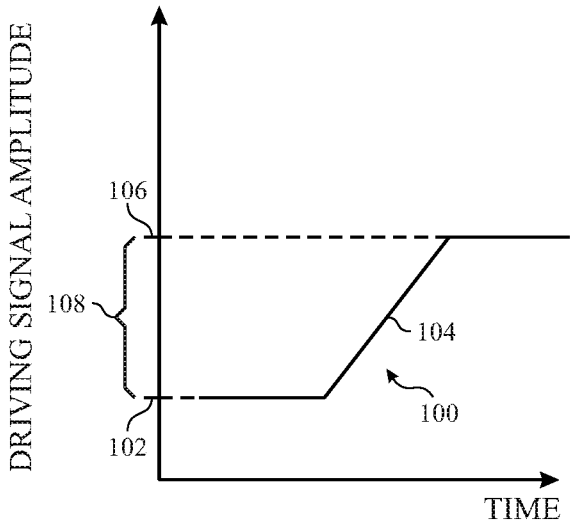
FIG. 6A is a graph of a first rate of change of the display of FIG. 5, in accordance with an embodiment.
Figure 6B:
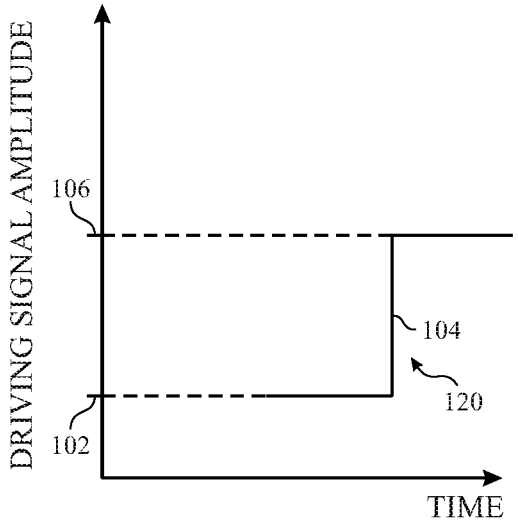
FIG. 6B is a graph of a second rate of change of the display of FIG. 5, in accordance with an embodiment.

To elaborate on the rate of change between values of the driving signal, FIG. 6A is a graph showing a first rate of change 100 between a first value 102 of the driving signal 104 and a second value 106 of the driving signal 104. When the difference 108 between the first value 102 and the second value 106 of the driving signal 104 is greater than or equal to a threshold, the slew booster may be used to increase the value of the driving signal 104 from the first value 102 to the second value 106 at a relatively faster rate of change. This additional voltage may be useful when a difference between the first value 102 and the second value 106 is large enough to cause a perceivable delay when adjusting the value of the driving signal without the additional voltage. Thus, when the voltage difference is too large, as defined via the threshold, buffer circuitry may take a longer time to pull the value of the driving signal from the first value 102 to become the second value 106 without connecting the additional voltage source via the slew booster. For example, FIG. 6B is a graph showing a second rate of change 120 between the first value 102 of the driving signal 104 and the second value 106 of the driving signal 104. Comparing the first rate of change 100 to the second rate of change 120 shows that the second rate of change 120 is relatively faster than the first rate of change 100. It is noted that although depicted as positive rates of the change, the first rate of change 100 and/or the second rate of change 120 may be positive rates of change and/or negative rates of change.

Figure 7:
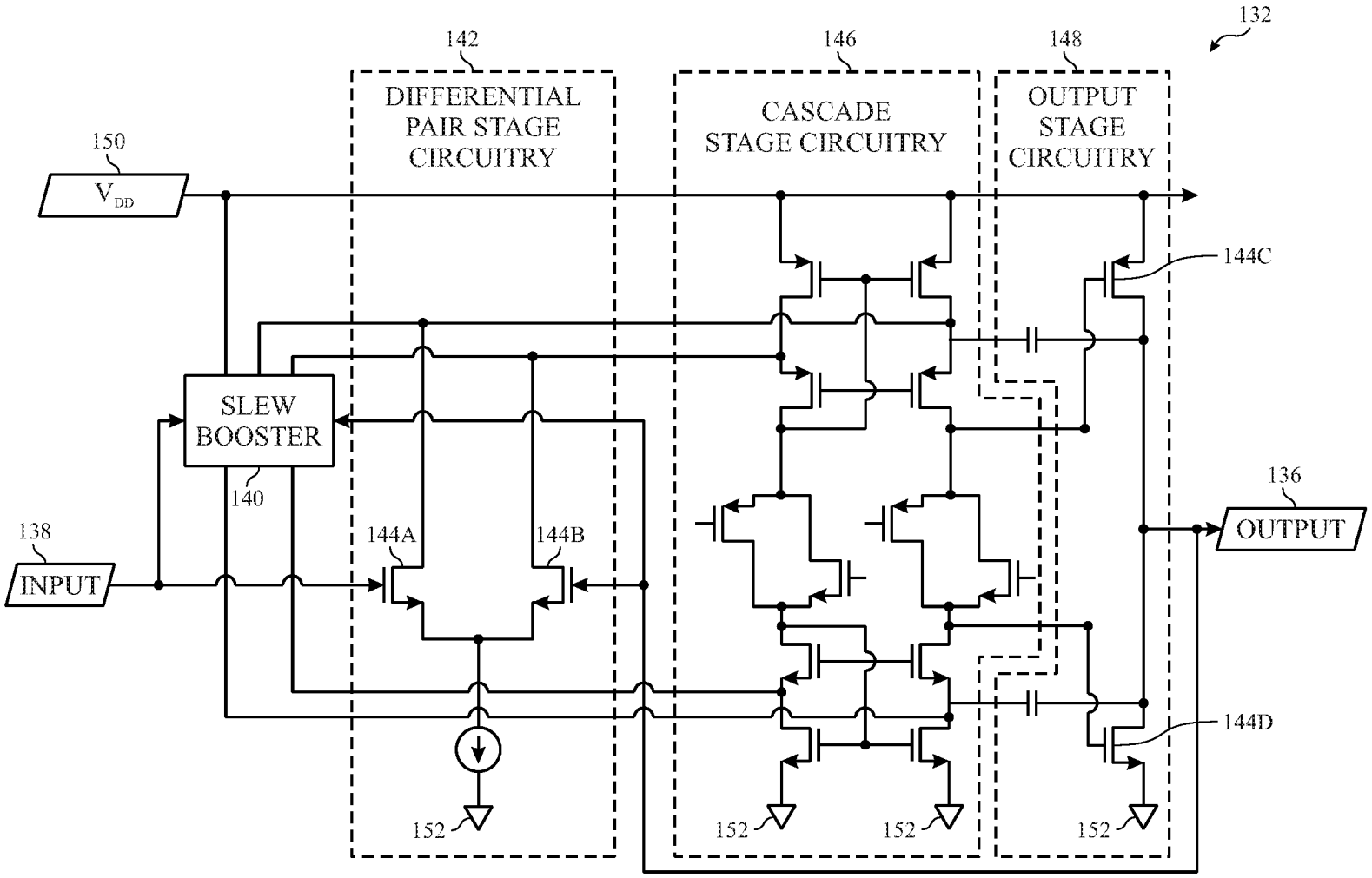
FIG. 7 is a block diagram of driving circuitry driven to adjust the first rate of change of FIG. 6A into the second rate of change of FIG. 6B, in accordance with an embodiment.

FIG. 7 is a block diagram of buffer circuitry 132 of the display 18 in accordance with embodiments described herein. The electronic device 10 may include the buffer circuitry 132 in a variety of locations, including one or more of the drivers 86. The buffer circuitry 132 receives, via a feedback path 134, a first driving signal (e.g., output driving signal 136). The buffer circuitry 132 also receives a second driving signal (e.g., input driving signal 138). The first driving signal (e.g., output driving signal 136) may correspond to a current image presentation of the display 18 (e.g., a first line), and thus may be a driving signal previously used to cause the pixel 82 to emit light. The second driving signal (e.g., input driving signal 138) may be a driving signal that corresponds to a portion of an image to be displayed via a next line as light emitted from the pixel 82 (e.g., a second line subsequent to the first line). The first driving signal (e.g., output driving signal 136) and the second driving signal (e.g., input driving signal 138) may be analog data signals. Thus, the pixel 82 may emit light proportional to a value (e.g., amplitude) of the analog data signal used to drive the pixel 82. In this way, the first driving signal (e.g., output driving signal 136) and the second driving signal (e.g., input driving signal 138) may correspond to gray levels of a portion of the image to be presented via the display 18. The buffer circuitry 132 may operate to adjust the output driving signal 136 to a value equal to a value of the second driving signal (e.g., input driving signal 138).

The first driving signal (e.g., output driving signal 136) and the second driving signal (e.g., input driving signal 138) may be received at a slew booster 140 and at differential pair stage circuitry 142. The differential pair stage circuitry 142 may be an operational amplifier formed from transistors 144 (144A, 144B). The differential pair stage circuitry 142 may electrically couple to cascade stage circuitry 146 of the buffer circuitry 132. The cascade stage circuitry 146 may drive output stage circuitry 148. In this way, the cascade stage circuitry 146 may drive the output stage circuitry 148 to use a system high voltage (VDD) 150 or a system low voltage (VSS) 152 to adjust a value of the output driving signal based on the value of the second driving signal (e.g., input driving signal 138). The cascade stage circuitry 146 may synchronize outputs from the output stage circuitry 148, such that the transistor 144C and the transistor 144D are not switched on at a same time (e.g., are not overlapping in switching).

To describe operation of the buffer circuitry 132 further, when buffering the input pixel data (e.g., corresponding to the input driving signal 138), the differential pair stage circuitry 142 may amplify the difference between the voltage previously output by via the output stage circuitry 148 to the pixel 82 (e.g., output driving signal 136) and the input voltage currently being provided to the buffer circuitry 132 (e.g., input driving signal 138) for output via the output stage circuitry 148. The previously output voltage is provided to the gate of transistor 144B of the differential pair stage circuitry 142, while the input voltage is provided to the gate of transistor 144A of the differential pair stage circuitry 142. The amplified difference in current due to the difference in driving the transistors 144A, 144B may be provided to the cascade stage circuitry 146, which may increase the strength of the signal associated with the amplified difference to drive the output stage circuitry 148. That is, for example, if the amplified difference output by the differential pair stage circuitry 142 is indicative of a voltage change from negative (e.g., low) to positive (e.g., high), the cascade stage circuitry 146 may increase the strength of the positive signal by driving a gate of the transistor 144C of the output stage circuitry 148. Similarly, if the amplified difference output by the differential pair stage circuitry 142 is indicative of a voltage change from a high voltage to a lower voltage, the cascade stage circuitry 146 may increase the strength of the low voltage signal by driving a gate of the transistor 144D of the output stage circuitry 148. It is noted that although depicted as transistors, the transistors 144 may be any suitable switching circuitry or switch, including any suitable transistor in addition to or instead of N-type metal-oxide-semiconductor (NMOS) configurations and/or P-type metal-oxide-semiconductors (PMOS) configurations.

The slew booster 140 and the differential pair stage circuitry 142 may operate at least partially simultaneous. The transistors 144 of the differential pair stage circuitry 142 may be mirrored inside of the slew booster 140. In this way, the transistors 144 are depicted in an NMOS configuration while transistors of the slew booster 140 may be arranged as a PMOS configuration. Transistor mirroring may be used to amplify signals provided from the differential pair stage circuitry 142 to the cascade stage circuitry 146. It is noted that transistors 144 may be PMOS transistors and transistors of the slew booster 140 may be NMOS transistors.

The slew booster 140 may detect a difference between a value of the first driving signal (e.g., output driving signal 136) and a value of the second driving signal (e.g., input driving signal 138). In response to the difference being greater than or equal to a threshold, the slew booster 140 may couple an additional current source (e.g., VDD) to the differential pair stage circuitry 142. A value of the threshold may be established through properties of Stuckey diodes included in the slew booster 140, circuitry internal to the slew booster 140, properties of the differential pair stage circuitry 142 coupled to the slew booster 140, or the like. When the detected difference is not greater than the threshold, the slew booster 140 may not couple the additional current source to the differential pair stage circuitry 142.

With this in mind, the slew booster 140 may act as a current mirror to the differential pair stage circuitry 142 when the difference between the first driving signal (e.g., output driving signal 136) and the second driving signal (e.g., input driving signal 138) is greater than or equal to the threshold, thereby coupling an additional current source to the differential pair stage circuitry 142. By including the additional current supplied from the slew booster 140, the rate of change associated with value of the driving signal output to the pixel may improve (e.g., increase). That is, the rate of change may increase since a relatively greater current value is used as the control signal supplied to the transistors 144C, 144D of the output stage circuitry 148. When the control signal supplied to the transistors 144C, 144D is relatively larger, the transistors 144C, 144D are driven harder, and thus output a larger drain current. A larger drain current may change the value of the output driving signal to a desired value (e.g., to the input driving signal 138) relatively faster, thus improving operation of the buffer circuitry 132.

By way of operation, in one embodiment, the buffer circuitry 132 may receive the first driving signal (e.g., output driving signal 136). The first driving signal (e.g., output driving signal 136) may be a signal previously used to cause a pixel to emit light at a first gray level. The buffer circuitry 132 may receive the second driving signal (e.g., input driving signal 138) representative of a desired next, second gray level desired for the pixel to emit light. Using the slew booster 140, the buffer circuitry 132 may determine a difference between the first driving signal and the second driving signal. Components of the slew booster 140 may establish a threshold that is used as a reference for the difference. The components of the slew booster 140 may use material properties (e.g., resistances, capacitances, threshold voltages) to define the threshold.

When the difference is greater than or equal to the threshold, the buffer circuitry 132 operates, via the slew booster 140, to couple an additional current source to the differential pair stage circuitry 142. The slew booster 140 may provide the additional current to the transistor 144A or the transistor 144B based at least in part on the difference. For example, when the difference is negative, the slew booster 140 provides the additional current to transistor 144A or the transistor 144B while when positive, the slew booster 140 provides the additional voltage to the other of the transistor 144A or the transistor 144B.

The differential pair stage circuitry 142 may amplify a difference between the first driving signal (e.g., output driving signal 136) and the second driving signal (e.g., input driving signal 138) based at least in part on a total voltage value supplied to the differential pair stage circuitry 142 (e.g., from VDD 150 and/or from the slew booster 140). The amplified current generated by the differential pair stage circuitry 142 may transmit to the cascade stage circuitry 146. The cascade stage circuitry 146 may strengthen a signal provided to the output stage circuitry 148 based on the amplified difference (e.g., amplified current) generated by the differential pair stage circuitry 142. The cascade stage circuitry 146 may use the amplified current to select either transistor 144C or transistor 144D to generate the output driving signal. Since the amplified current is used as a gate control signal to activate either transistor 144C or transistor 144D, the resulting output driving signal may be driven harder relatively to a current value of the gate control signal. In this way, when the difference between the first driving signal (e.g., output driving signal 136) and the second driving signal (e.g., input driving signal 138) is relatively larger, a relatively larger current value is supplied to the output stage circuitry 148 to drive the transistor 144C or the transistor 144D harder (e.g., such that transistor 144C or transistor 144D switches faster and/or outputs a larger drain current).

It is noted that when the difference is determined to be less than the threshold, the slew booster 140 may not couple the additional current source to the differential pair stage circuitry 142. Thus, the slew booster 140 may consume less power and/or may be disconnected from the VDD 150. It is noted that some characteristics of the buffer circuitry 132 itself, such as noise, input offset, or power output are not affected by addition of the slew booster 140. In this way, when the difference is determined to be greater than or equal to the threshold, the slew booster 140 may be coupled to the VDD 150 and provide additional voltage to the differential pair stage circuitry 142.

In some embodiments, slew boosters 140 are included on a per-pixel basis, such that each pixel corresponds to a respective slew booster 140. In some cases, one or more slew boosters 140 may be shared between one or more pixels 82. In this way, a slew booster 140 may be shared on a regional-basis. Additionally or alternatively, a slew booster 140 may be provided per row of pixels 82 or per column of pixels 82. For example, a slew booster 140 may cause the output stage circuitry 148 to provide the output driving signal to one or more rows of pixels 82.

Thus, the technical effects of the present disclosure include driving circuitry that includes a slew booster. The slew booster may be selectively powered on in response to a determination of a difference between sequential gray levels that a pixel is to emit light at to present. Gray levels may be represented by driving signals and/or data signals. The slew booster, or other circuitry of the driving circuitry, may compare signals representative of the gray levels to determine the difference. When the difference is greater than or equal to a threshold, the slew booster may power on and provide additional voltage used to drive output circuitry to adjust a driving signal used to drive a pixel. In this way, the slew booster may provide additional voltage to switch an output transistor relatively faster or provide additional voltage to increase a value of the output driving signal faster. For example, when driving a pixel with an analog driving signal, the slew booster may provide additional voltage to adjust the value of the analog driving signal at an improved rate (e.g., faster), such as via the cascade stage circuitry using the additional voltage to generate a gate control signal for switching a transistor at an improved rate (e.g., faster).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system, comprising:

a pixel of a plurality of pixels, wherein the pixel is configured to emit light at a gray level associated with a driving signal applied to the pixel, wherein the gray level indicates a value within a light emission range associated with the pixel; and buffer circuitry comprising slew booster circuitry and differential pair circuitry, wherein the buffer circuitry is configured to:

receive an input signal representative of image data for display via the pixel at the slew booster circuitry and the differential pair circuitry; and provide a first driving signal during a first frame of the image data to the pixel based on the input signal, wherein the slew booster circuitry configured to supply a voltage boost to the differential pair circuitry in response to a difference between a first gray level associated with the input signal and a second gray level associated with a second driving signal exceeding a threshold change, and wherein the second driving signal is provided to the pixel during a second frame of the image data preceding the first frame, wherein the slew booster circuitry is configured to perform a current mirror operation with respect to the differential pair circuitry.

2. The system of claim 1, wherein the buffer circuitry comprises:

output circuitry configured to couple to the pixel; and cascade circuitry configured to couple to the output circuitry and the differential pair circuitry.

3. The system of claim 2, wherein the slew booster circuitry is configured to cause the output circuitry to provide the driving signal to one or more rows of the plurality of pixels.

4. The system of claim 2, wherein the differential pair circuitry is configured to:

amplify an additional difference between the input signal and the second driving signal; and provide the amplified additional difference to the cascade circuitry.

5. The system of claim 4, wherein the cascade circuitry is configured to strengthen a signal provided to the output circuitry based on the amplified additional difference.

6. The system of claim 2, wherein the output circuitry comprises a P-type metal-oxide-semiconductors (PMOS) switch configured to couple to a first voltage source and an N-type metal-oxide-semiconductor (NMOS) switch configured to couple to a second voltage source.

7. The system of claim 2, wherein the output circuitry is configured to couple to the slew booster circuitry to provide the second driving signal to the slew booster circuitry as feedback.

8. The system of claim 1, wherein the slew booster circuitry is configured to disable in response to the difference being less than the threshold change.

9. The system of claim 8, wherein disabling the slew booster circuitry comprises disconnecting the slew booster circuitry from a voltage source.

10. A buffer circuit, comprising:

differential pair circuitry comprising a current source; and slew booster circuitry coupled to the differential pair circuitry, wherein the slew booster circuitry is configured to:

detect a difference between a first gray level corresponding to a first value of a first driving signal and a second gray level corresponding to a second value of a second driving signal based on the first value of the first driving signal and the second value of the second driving signal, wherein the first driving signal and the second driving signal are configured to cause a pixel of an electronic display to emit light at the first gray level and the second gray level, respectively; and in response to the difference being greater than or equal to a threshold, couple an additional voltage source to the differential pair circuitry, wherein the slew booster circuitry is configured to perform a current mirror operation with respect to the differential pair circuitry.

11. The buffer circuit of claim 10, wherein the current source is coupled between one or more switches associated with the differential pair circuitry and a ground voltage terminal.

12. The buffer circuit of claim 11, wherein the one or more switches comprise a first switch configured to receive the second driving signal and a second switch configured to receive the first driving signal, wherein the differential pair circuitry is configured to amplify the difference between the first driving signal and the second driving signal, and wherein the difference corresponds to an amplitude value.

13. The buffer circuit of claim 12, wherein the differential pair circuitry is configured to output the amplified difference in amplitude to circuitry coupled between the differential pair circuitry and the pixel.

14. The buffer circuit of claim 10, comprising a plurality of switches arranged as cascade circuitry configured to couple between the slew booster circuitry and the pixel, wherein the plurality of switches is configured to increase an amplitude of the first driving signal provided to the pixel.

15. The buffer circuit of claim 10, wherein the slew booster circuitry is configured to, in response to the difference being less than the threshold, disconnect the additional voltage source from the differential pair circuitry.

16. The buffer circuit of claim 10, wherein the slew booster circuitry couples the additional voltage source to increase an amplitude of the first driving signal and a third driving signal, and wherein the third driving signal is configured to cause an additional pixel of the electronic display to emit light.

17. A method comprising:

detecting, via circuitry, a difference between a first gray level corresponding to a first value of a first driving signal and a second gray level corresponding to a second value of a second driving signal based on the first value of the first driving signal and the second value of the second driving signal, wherein the first driving signal and the second driving signal are configured to cause a pixel of an electronic display to emit light at the first gray level and the second gray level, respectively;

determining, via the circuitry, the difference as being greater than or equal to a threshold corresponding to an amount of change between the first value of the first driving signal and the second value of the second driving signal, wherein the amount of change is determined based on one or more resistances of the circuitry, one or more capacitances of the circuitry, one or more threshold voltages of the circuitry, or any combination thereof; and in response to the difference being greater than or equal to the threshold, adjusting, via the circuitry, an amount of voltage supplied to differential pair circuitry to adjust an amplitude of the second driving signal before using the second driving signal to cause the pixel of the electronic display to emit light, wherein the differential pair circuitry is configured to couple to the circuitry.

18. The method of claim 17, comprising:

receiving, via the circuitry, the first driving signal after the first driving signal is used to cause a first light emission from the pixel for a first frame of image data; and receiving, via the circuitry, the second driving signal before using the second driving signal to cause a second light emission from the pixel for a second frame of the image data immediately after the first frame.

19. The method of claim 17, comprising, in response to the difference being less than the threshold, disconnecting an additional voltage source from the differential pair circuitry.

20. The method of claim 17, comprising:

determining whether the difference comprises a positive value or a negative value;

in response to the difference comprising the positive value, coupling an additional voltage source to the differential pair circuitry at a first switch configured to couple to a first input of a network of switches coupled to the pixel; and in response to the difference comprising the negative value, coupling the additional voltage source to the differential pair circuitry at a second switch configured to couple to a second input of the network of switches coupled to the pixel.

* * * * *